US006079903A

United States Patent [19]

Wagner et al.

[11] Patent Number: 6,079,903

[45] Date of Patent: Jun. 27, 2000

[54] DRAIN CHANNEL SYSTEM

[76] Inventors: Frank Wagner, Haftnerweg 4, D-76532; Peter Kruse, Lange Strasse 87; Martin Dietrich, Jagdhausstrasse 2, both of D-76530, all of Baden-Baden; Henrdik Wahl, Merowingerstr. 12, D-82166 Graäfelfing, all of Germany

[21] Appl. No.: 09/053,158

[22] Filed: Apr. 1, 1998

[51] Int. Cl.[7] ..... E02B 13/00

[52] U.S. Cl. ..... 405/36; 404/4; 405/46

[58] Field of Search ..... 405/36, 40, 41, 405/53, 118, 119, 120, 121, 46, 47; 404/2, 3, 4, 5; 52/21

[56] References Cited

U.S. PATENT DOCUMENTS

| | | | |
|---|---|---|---|
| 2,802,339 | 8/1957 | Fogerty | 405/47 |
| 3,501,007 | 3/1970 | Davis | 405/36 |
| 3,919,848 | 11/1975 | Sullivan | 405/43 |
| 4,031,009 | 6/1977 | Hicks | 405/36 |
| 5,501,547 | 3/1996 | Mantelli | 405/118 |
| 5,575,925 | 11/1996 | Logue, Jr. | 404/4 |

FOREIGN PATENT DOCUMENTS

| | | | |
|---|---|---|---|
| 325943 | 3/1930 | United Kingdom | 404/4 |

OTHER PUBLICATIONS

Time–Saver Standards, "Drainage Details", p. 92, undated.

*Primary Examiner*—Eileen Dunn Lillis
*Assistant Examiner*—Frederick L. Lagman
*Attorney, Agent, or Firm*—Cantor Colburn LLP

[57] ABSTRACT

A drain channel system comprising a channel with a lower channel section, which lower channel section incorporates a continuous cavity that is open toward the bottom and underneath which a seepage area is located for draining off surface water, the cavity being connected to a reservoir, a box drain or collecting tank, the reservoir, box drain or collecting tank being connected on its part to a device for feeding in surface water, and a dirt filter being provided in the reservoir, box drain or collecting tank, or between the reservoir or box drain or collecting tank and the cavity.

19 Claims, 4 Drawing Sheets

DRAIN CHANNEL SYSTEM

FIELD OF THE INVENTION

The invention herein presented relates to a drain channel system designed in particular for the draining of partially and fully sealed surfaces.

BACKGROUND OF THE INVENTION

There have been earlier approaches to the draining of partially or fully sealed surfaces with the aid of a seepage system. The method employed to date involves the installation of run-off channels in the sealed sections which channels lead into a system of drain pipes. The major drawback of such a system lies in the fact that, over time, the drain pipes clog up, that servicing these pipes is an extremely complex matter and that the soil around these pipes tends to settle.

The German patent DE 44 03 454 C1 describes a profiled, U-shaped concrete block or drain tile that is open toward the top and serves as the intake section. This intake section is provided with a biological screen the function of which is to biologically filter the incoming water. The lower, horizontal section of the U-block features perforations allowing the water that enters the channel to seep through these perforations into the soil underneath the drain tile. The shortcoming of this channel consists in very limited draining efficiency and the potential for a relatively rapid settling of the soil underneath the concrete block. Moreover, it is quite difficult with this design to compensate for differences in the amount of water collected over the length of the channel, causing fairly quick flooding of the channel in overload situations.

DE 28 35 124 C2 describes a pipe system for soil irrigation and draining. This system consists of two pipes, one inside the other and both partially water-permeable at least in their bottom sections. During the installation, the outer pipe with the larger diameter is slightly flattened so as to give it an ellipsoid profile with a somewhat broader irrigation or drainage capacity. However, a pipe of this type is only suitable for watering and dewatering plants, given that the influx of larger amounts of water, as in the case of drainage systems, could easily cause the soil to pack down.

DE-U-94 15 774 describes a ground cover that can be assembled from profiled, square stone tiles. Water can seep into the grooves between the stone tiles and drain off into the ground through lateral duct channels molded into the tiles. Here again, the problem is relatively quick clogging of the grooves at the points of entry of the drainage water due to the silting effect. Besides, stone tiles of this type cannot be assembled into a contiguous surface in a way as to permit easy movement for instance of shopping carts or forklifts.

SUMMARY OF THE INVENTION

The above-discussed and other problems and deficiencies of the prior art are overcome or alleviated by the present invention which provides a drain channel system which is easy to maintain while minimizing the potential for the soil to settle.

A common feature of all the drainage designs of the present invention is an open downward channel, i.e. inverted U section which receives the surface water. Located underneath this continuous cavity is the seepage area with a ballast bed which may have a specific grain size distribution so selected as to inhibit alluvial sedimentation while possibly promoting biological growth. The air permeating the cavity of the channel section permits the accumulation of aerobic bacteria, thus creating a certain subterranean biological cleaning process much like the one that takes place in the natural topsoil (humus). In this fashion, the biorganic growth can bind ultrafine particles and even toxic substances which counters the clogging of the seepage area and the surrounding soil and may even be conducive to a partial organic purification of the drain water. The seepage area may be separated from the cavity by a dirt filter such as a metal screen, a geofibrous fabric or a louvered separator capable of inhibiting the introduction of ultrafine particles in the seepage area and again promoting biorganic growth. For pressure flushing or vacuuming of the geofabric filter during maintenance work it is desirable to provide the fabric with a reinforcing screen backing on one or both sides to prevent damage during the cleaning process. In this context the cavity channel should be accessible from at least one end. The channel section that is open toward the bottom receives the water either by way of an upper channel section or via a reservoir, a box drain or some other surface water collection system (e.g. a gutter). The geofabric may be mounted in the channel in removable fashion, for instance in longitudinal slots, so that it can be replaced in the event it is clogged by particulate matter. It is possible to drain off water not only into the seepage area but also into the supporting bed next to the channel if it consists of a suitable material (for instance gravel).

In a first embodiment of the drain channel according to this invention, the intake area is essentially the same as the seepage area. In this system, a drain channel includes an upper channel section which receives the water from the sealed or partially sealed surface, and a downward-pointing bottom section with a continuous cavity which receives the surface water for instance from the upper channel section by way of intermediate openings or, at its ends, from a box drain or holding tank or other type of reservoir or treatment system. The water entering the inverted U-shaped cavity of the channel bottom section seeps into the ground in the seepage area underneath the channel bottom section. The seepage area can be protected from clogging by means of the aforementioned dirt filter such as a rodent-proof and backwash-protected fabric. In one embodiment, the mouth of the conduit leading into the upper channel section is raised above the gullet bottom of the upper channel section so as to protrude beyond the water level, serving as an overflow device. As a result, dirt entering the upper channel section will accumulate in the gullet and only clean water will flow through the conduit into the lower channel section underneath. This virtually prevents any clogging of the conduits between the upper and the lower channel sections. As an alternative, or in addition, a dirt filter may be incorporated in the conduits between the upper and lower channels. Where a box drain is used, the mouth of the lower channel section leading into the box drain is located above the bottom of the box drain so that the latter serves as a settling tank. Coarse dirt particles and sand will settle in the box drain or reservoir, so that the water entering the lower channel is relatively clean. In addition, or as an alternative, a dirt filter may be installed between the surface-water intake and the cavity mouth leading into the box drain.

Compared to conventional systems employing drain pipes, this invention offers the advantage of permitting the installation of the drainage and seepage system and the water run-off in one operation. Such systems can even be retrofitted to existing, partially sealed surfaces. They can be installed independent of any sewerage lines. It is not necessary for the run-off to be in the form of continuous drainage lines. The channels may be installed in single units, a fact which provides great flexibility in the layout of a partially sealed surface. Furthermore, the channels need not be sloped.

The fact that the space above the seepage area contains nothing but the drain channel itself rather than additional soil as in the case of conventional drain pipes, largely eliminates the settling of any such soil. This may be further enhanced by bracing the lower channel sections against wide concrete beds or by widening the seepage area and/or by flaring the downward lateral supports i.e. side walls.

The drain channel is preferably designed in the form of two back-to-back coaxial U-profiles whose open ends point in opposite directions, the right-side-up U-profile constituting the upper channel section, the inverted U-profile under it constituting the lower channel section. Where they meet, the upper and lower channel sections are slightly widened so as to form a larger contact surface between them as well as a bilateral ledge in the transition area which aids in the load distribution for the lower channel while serving as a back-wash barrier for the upper channel. The upper and lower channel sections preferably consist of identical U-profiles which reduces the tooling cost in the overall channel production.

The cross section of the gullet of the upper channel section is preferably asymmetric, i.e. the gullet is offset toward one of the vertical sidewalls, while the mouth of the conduit is positioned off-center closer to the opposite channel wall, meaning that the mouth of the conduit is located in the inclining section of the gullet away from the base of the gullet. Dirt entering the upper channel section thus accumulates on the bottom of the gullet while the mouth of the conduit serves as the overflow. The circular holes for the conduits are drilled through the identical, back-to-back U-profiles after assembly so as to avoid dirt and resulting water backup due to otherwise possible axial or lateral misalignment of the holes. The flared, preferably circular transition in the openings ensures unimpeded water flow between the upper and lower channel sections even in the event of minor misalignment. A dirt filter may be installed as well.

The profiled sections for the upper and lower channels—whether identical or not—are preferably made of cast concrete, polymer concrete or a synthetic material.

Using a two-part drain channel has the advantage of considerably facilitated transportation and on-site channel assembly. However, it is equally possible to use a single-mold channel the upper part of which opens up toward the top while its lower section opens up toward the bottom. A drain channel of that type is essentially H-shaped. Better draining efficiency is obtained if the lower channel section is wider than the upper channel section, in that the cavity and the seepage area underneath the channel are larger than the intake area defined by the upper channel, thus enhancing the drainage capacity of the channel.

As described above, the water feed from the upper channel section to the lower channel section can be obtained by means of vertical conduits extending through the partition horizontally separating the upper from the lower channel section. However, as an alternative or in addition thereto, a dry-well, box drain or reservoir may be installed at the end of a drain channel for collecting the water entering the upper channel section and passing it on to the lower channel section. In that case, the mouth of the lower channel section leading into the box drain should be located sufficiently above the box-drain floor. The box drain, or reservoir as the case may be, thus serves as a settling tank in which coarse dirt particles accumulate. An oil separator may be installed in the area of the box drain and/or reservoir, permitting the drainage of slightly oily surface water. In lieu of a reservoir or box drain a holding tank or water treatment system may be connected for collecting the water entering through the upper channel section. The function of the upper channel section can thus be temporally separated from that of the lower channel section. It is also possible to use the upper and lower channel sections independently of one another which significantly broadens their potential utilization. The mouth of the lower channel section leading into the box drain will then act as the overflow for the box drain through which mouth only relatively clean water will flow. This will largely eliminate dirt accumulation or clogging in the lower channel section. Preferably, a baffle is inserted in the mouth of the upper channel section, extending from the base of the gullet up to a specific height and preventing the dirt accumulating in the gullet from entering the box drain. This provides for a double-screening of coarse particles before they could enter the lower channel section.

The use of a box drain or reservoir has an added advantage in that it allows access to the lower channel section, i.e. to the cavity in the latter, from one end for easy maintenance. Of course, the box drain or reservoir can also be used for draining additional surfaces, for instance a gutter or eaves. The box drain or reservoir may also be equipped with an overflow leading into the sewerage system. Providing an overflow at the appropriate level, i.e. above the lower channel section, will prevent the water level in the lower channel from rising too high and affecting proper functioning of the overall drainage system.

The above-discussed and other features and advantages of the present invention will be appreciated and understood by those skilled in the art by the following description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
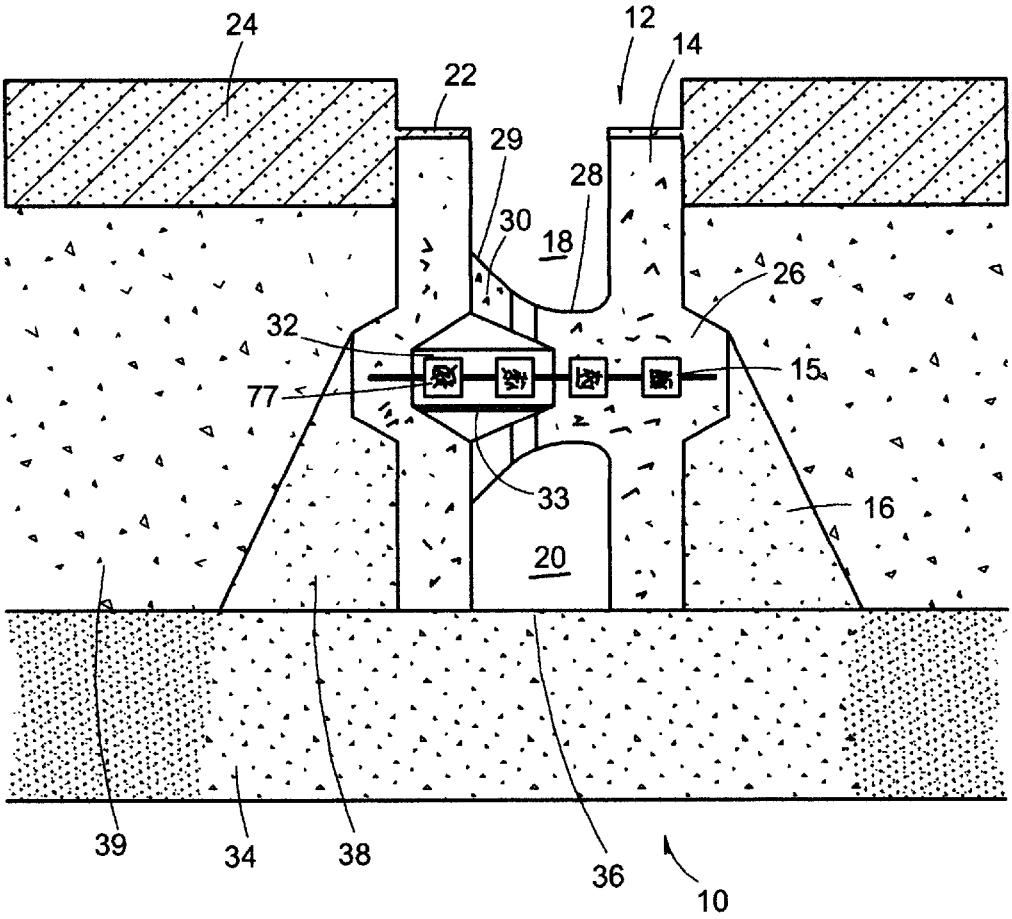
FIG. 1 shows the cross section of a two-part drain channel with a conduit between the upper and lower channel segments along line A—A in FIG. 2.

Illustrated in FIG. 1 is a drain channel system 10 including a two-part drain channel 12 consisting of an upper channel section 14 and a lower channel section 16. The upper channel 14 and the lower channel 16 are identical cast-concrete U-profile blocks. The two U-profiles 14, 16 butt against each other with their horizontal base 15, the said horizontal bases 15 constituting the boundary between the intake area 18 and the downward cavity 20 of the drain channel 12. In the longitudinal direction of the groove, the bottom contact surface 17 is provided with a rectangular serration serving to prevent the mortar used in the assembly from separating and floating into the cavities while interlocking the upper and lower channel sections. Instead of a rectangular serration, a deltoid or sinusoid serration will serve as well. Alternatively or additionally, the serration may be provided perpendicular to the axis of the channel.

The two top ends of the vertical legs of the upper channel segment 14 each support an L-bracket 22 (ledge) whose vertical legs point away from each other. This creates a frame for holding a screening grate. The upper edges of the L-brackets 22 are perfectly flush with a sealed surface such as an asphalt layer 24 which is to be drained of water by the drain channel.

Figure 2:
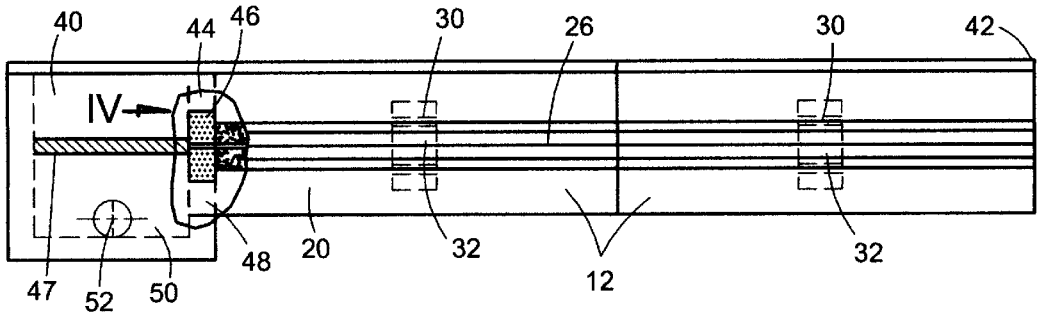
FIG. 2 is a lateral view of a drain channel system including a box drain and two 2-part drain channels connected to it.

In the area of their horizontal contact base surfaces 15, the identical upper section 14 and lower section 16 of the channel are provided with a collar 26, producing a larger contact surface between the two sections 14, 16 for greater structural stability when these two segments 14, 16 are assembled. The upper channel 14 contains a gullet 28 which, in its cross section, is slightly offset relative to its central axis, in this case toward the right side. Toward the left the gullet follows an incline 29. Located in this incline 29 is the conduit opening 30 which connects the intake area 18 with the cavity 20. The conduit opening 30 is flared toward the bottom or horizontal base 15 of the upper channel section 14 into a circularly widened flange opening 32 which matches the corresponding flange opening 32 of the identical lower channel section 16. The conduits 30, 32 may optionally be provided with a dirt filter 33 such as a metal screen, a geofabric or a louvered separator preferably mounted in exchangeable fashion. To assure that the flange opening 32 of the upper channel section 14 will always line up with the flange opening 32 of the lower channel section 16 it is necessary to locate the openings in mirror-symmetric fashion relative to the central axis of the channel. As shown in FIG. 2, the openings 30, 32 are axially (i.e. longitudinally) positioned in the center of each channel 12. This will ensure that any identically shaped block can be used for the upper as well as the lower channel section. The upper channel section 14 and the lower channel section 16 rest on a permeable layer of soil 34 which, underneath the drain channel, may be loosened up once more in the seepage area 36 and mixed with a rodent-proof and backwash-protected web installed in the plane between the cavity 20 and the seepage area 36. A web of this type may consist of a geofabric which protects the seepage area 36 located underneath the cavity 20 against the deposition of fine particles and thus against premature clogging. The geofabric may also perform a control function for building a biomass in the seepage area. The geofabric itself may be wider than the separating plane between the cavity and the seepage area, allowing the channel to sit on the fabric. Since maintenance work should include the periodic cleaning of the geofabric, the latter may be provided with a support screen or netting on one or both sides. This will permit pressure-cleaning of the cavity and thus of the geofabric without destroying the latter. Moreover, the intermediate layer, i.e. the geofabric, will effectively protect the cavity 20 against debris emanating from the seepage area 36. The drain channel 12 is held in place on the soil layer 34 by means of concrete fills 38 which fills widen toward the bottom in pyramidal fashion. The concrete fills 38 extend all the way to the upper end of the widened collar 26 of the upper channel section 14, thus holding the upper channel section 14 and the lower channel 16 in place relative to each other while at the same time providing vertical support for the channel by butting against the collar 26 in the plane of contact i.e. along the base surfaces 15 of the two U-shaped segments 14, 16. This structure prevents the soil in the area of the drain channel from settling. The channel thus supported is surrounded with a layer of gravel or sand 39.

Figure 4:
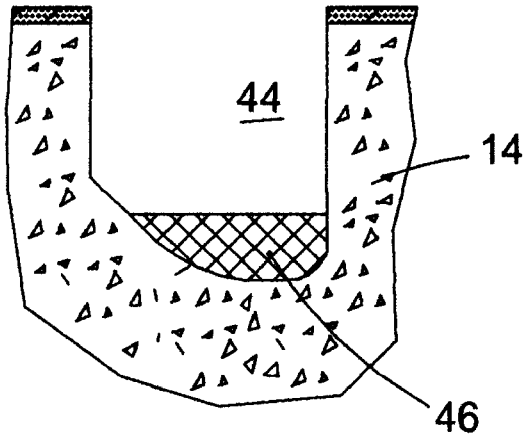
FIG. 4 shows detail IV of the mouth of the upper channel segment of the drain channel per FIG. 2 at the intake into the box drain.

As illustrated in FIG. 2, the two-part drain channel 12 may be connected at one end with a box drain 40. The other end is closed off with a cap 42, preventing any dirt around this cap 42 from entering the drain channel 12. Both the upper channel section 14 and the lower channel section 16 with their intake area 18 and, respectively, cavity 20 are open toward the box drain, as shown for the upper channel section 14 in FIG. 4, with a detail IV from FIG. 2. The openings 30, 32 between the upper channel section 14 and lower channel section 16 are represented by a broken line. FIG. 4 is a cross-sectional view of a detail at the end of the drain channel 12 where it transitions into the box drain 40. The water which enters the intake area 18 (FIG. 1) of the drain channel 12 travels through an opening 44 of the upper channel segment 14 and into the box drain 40. Toward the bottom, i.e. toward the base of the gullet 28, the opening 44 is limited by a baffle 46 which extends from the base of the gullet 28 (FIG. 1) up to a specific level within the intake area 18. This baffle 46 serves to prevent the debris collected in the gullet 28 from entering into the box drain 40. By way of another opening 48 further down, the lower channel section 16 connects to the box drain 40. Preferably, a dirt filter 47 is installed between the opening 44 of the upper channel section and the opening 48 of the lower channel section to keep dirt away from the cavity in the lower channel section and thus to prevent the seepage area in the ground from clogging. The bottom side of the opening 48 is at a certain distance from the floor of the box drain 40, allowing the latter to serve as a settling tank collecting coarse dirt particles. It follows that the cavity 20 in the lower channel section 16 receives only relatively clean water from the box drain 40 and therefore does not prematurely fill up with coarse dirt and sand.

The box drain 40 may further serve to feed waste water from other zones to be drained into the cavity 20 of the drain channel 12 (for instance from eaves). The box drain 40 may also be equipped with a sewerage connection 52 for use in cases where the drainage capacity of the drain channel is too limited to handle all of the incoming water.

Figure 3:
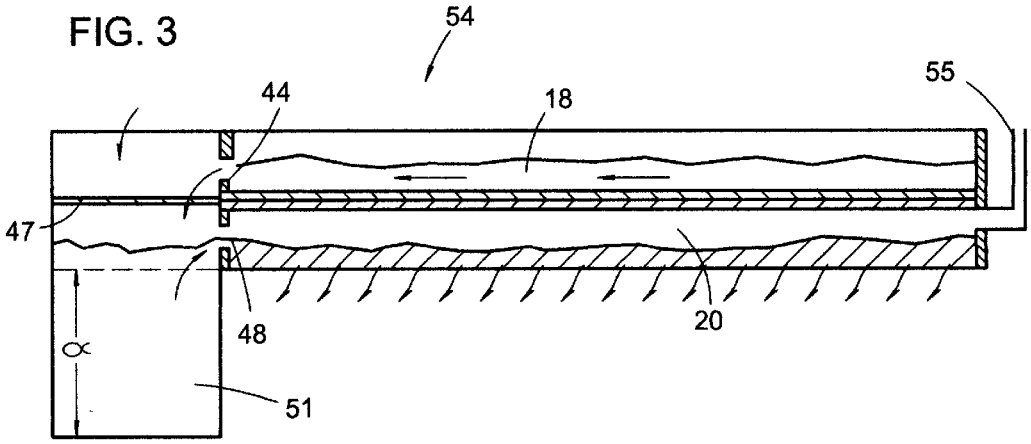
FIG. 3 shows a longitudinal section through a drain channel system including a drain channel with a reservoir connected at one end, where the upper and lower channel segments of the drain channel are separated from each other.

FIG. 3 shows another design version of a drain channel system with a two-part drain channel the end of which leads into a reservoir 51. Components physically or functionally identical to those in the preceding figures bear the same reference numbers. The drain channel system 54 illustrated in FIG. 3 is identical to that in FIG. 1, 2 and 4 except that no openings 30, 32 are provided between the upper channel segment 14 and the lower channel segment 16. The water entering the upper channel section 14 thus flows into the reservoir 51 by way of an opening 44 at the channel end and preferably through a dirt filter 47. The bottom 50 of the reservoir 51 is at a considerable distance d from the mouth 48 of the lower channel section 16. Thus, any water entering via the upper channel section 14 is cleaned in the reservoir 51 much like in a settling tank until it overflows via the end opening 48 into the cavity 20 of the lower channel section from where it seeps into the ground as indicated by the arrows. At the far end from the reservoir 51, the cavity 20 is provided with a vent 55 which allows the water to flow unimpeded from the reservoir 51 into the cavity 20 of the lower channel section. A similar vent may be provided in the embodiment per FIG. 2 as well, as long as there are no conduits or openings between the upper and lower channel sections or where these openings do not permit adequate venting.

Figure 5:
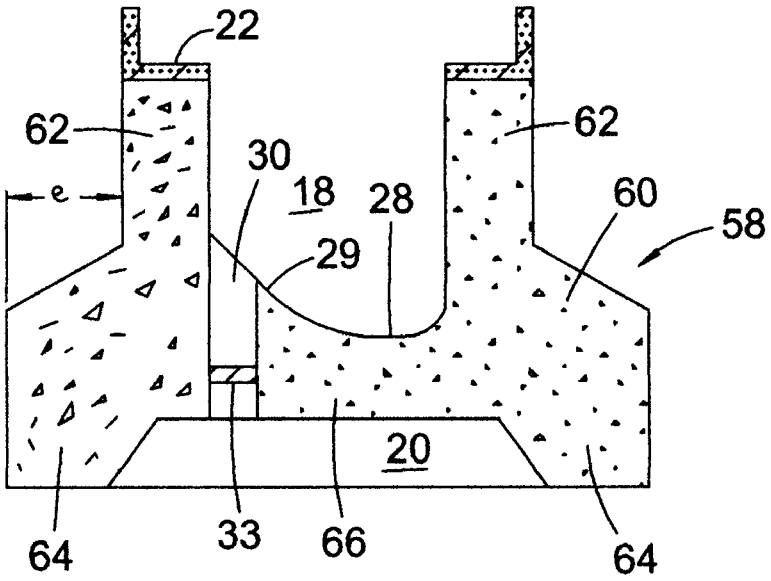
FIG. 5 shows a one-piece drain channel with integral upper and lower channel segments.

FIG. 5 shows another design version of a drain channel whose upper and lower channel sections are integrated into a single H-profile. Components physically or functionally identical to those in the preceding figures bear the same reference numbers. The drain channel 58 essentially consists of an H-profile 60 whose upper two legs 62 are closer together than the two vertical downward legs 64 below the horizontal base 66 which separates the inflow area 18 from the cavity 20. By virtue of the fact that the lower two legs 64 are spaced farther apart, by a distance e, than the upper vertical legs 62, the width of cavity 20 is substantially greater than that in the embodiments described earlier. In the drain channel 58 as well, the gullet 28 is asymmetric, i.e. offset to the right, while the conduit 30 from the intake area 18 to the cavity 20 extends through the left-hand incline 29 of the gullet 28. A dirt filter is preferably provided in this case to prevent the seepage area from clogging. This particular design offers very good drainage performance, it is positionally very stable due to its wide stance and it can be installed with a minimum of additional hold-down provisions. It lends itself especially well to situations where a low-profile drain channel is needed, for instance due to limited vertical space between the subsoil and the surface to be drained.

All of the above embodiments according to this invention have the advantage that, after removal of the grate, the entire intake area 18 and thus the gullet is accessible from the top over its full width, permitting easy cleaning. If a box drain or reservoir is used, the cavity 20 as well is easily accessible through the end opening 48 facing the box drain 40, permitting appropriate maintenance on its part. During operation the opening 48 may be closed off with a plug. Even without broad outrigger mounts, all of the embodiments minimize any settling of the ground. A widened lower channel section as per FIG. 5 may also be incorporated in a two-part channel per FIG. 1 to 4. Of course, in that case the profiles of the upper and lower channel sections will not be identical.

The openings 30, 32 between the upper and lower channel segments may be provided with a screen as protection against coarse debris and animals.

All channel components may be fabricated from concrete, synthetics, metal or other popular structural materials and compounds. The upper and lower channel sections may be produced from different materials.

For draining water from an overhead system such as eaves it may suffice to use a drain channel with the upper channel section, e.g. channel section 14 in FIG. 1, left off. A drain channel of that type thus consists merely of the lower channel section 16, albeit with a closed rather than partly permeable base 15. In that case, the channel is preferably connected at its end to the surface or overhead drain gutter. A channel of this type may still be used in conjunction with intake drain channels according to the examples described above, in order to provide greater drainage efficiency of the overall system.

Figure 6:
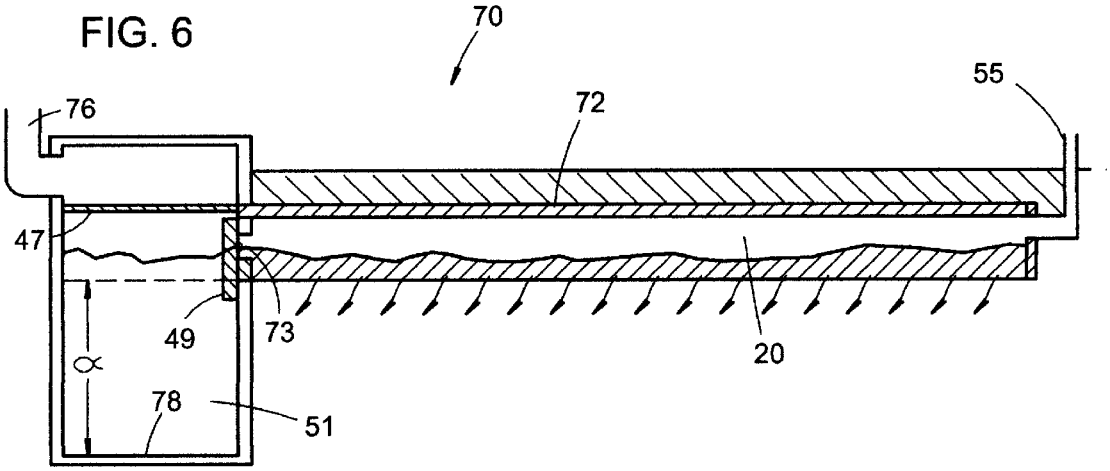
FIG. 6 shows a drain channel without the intake area.
Figure 7:
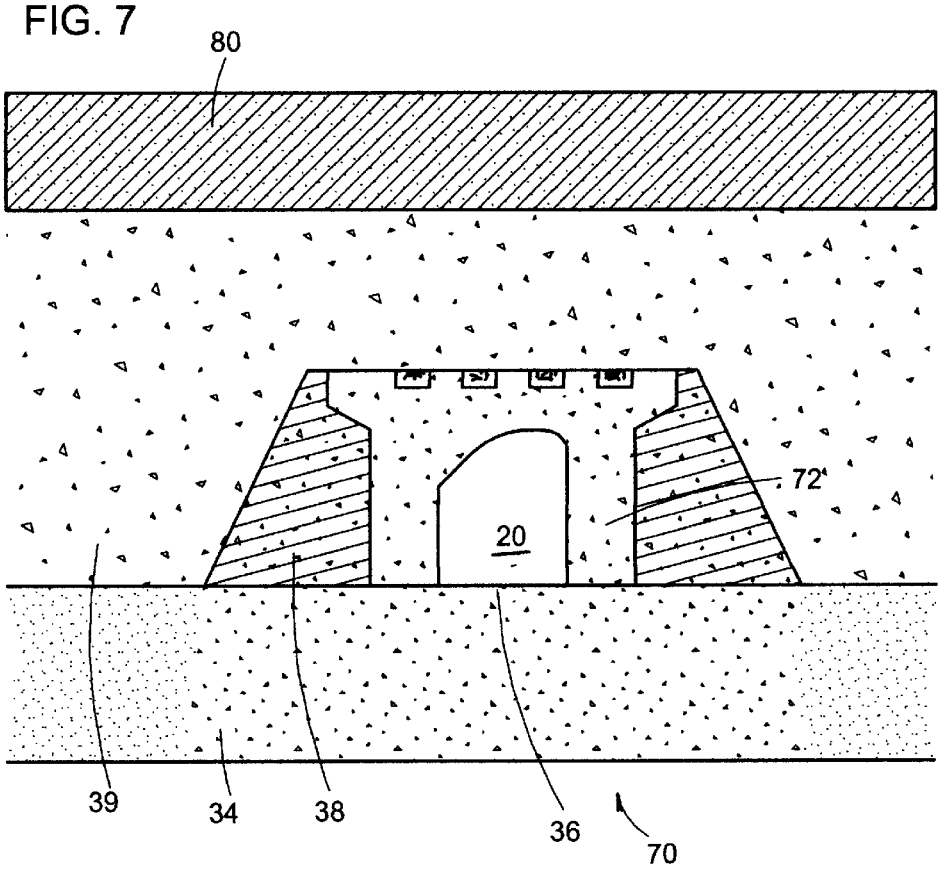
FIG. 7 is a cross section through a drain channel per FIG. 6.

FIG. 6 and 7 show a drain channel 70 with a subterranean channel body 72 having an open cavity 20 facing downward. At its end, the channel connects via a mouth 73 to a box drain 74. By way of a feed 76 the box drain 70 connects to a surface-water feed-in device. A dirt filter 47 is preferably installed between the feed 76 and the mouth 73. Alternatively, the dirt filter, in this case 49, may also be mounted directly at the mouth. The mouth 73 is located above the base 78 of the box drain by a distance d. As can be seen in FIG. 7, the space above the channel body 72 is a layer of asphalt 80.

In general, the drain channels of all the above design versions will be produced in the form of axially connectable channel modules.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Drain channel system comprising:

a channel with an upper channel section and a lower channel section separated from each other by at least one horizontal, partly permeable partition;

the upper channel section incorporating an intake area that is open toward the top, and a gullet for collecting and moving incoming water;

the lower channel section incorporating a continuous cavity which is open toward the bottom and underneath which a seepage area is located for draining off surface water;

the intake area being connected with said cavity by way of at least one conduit opening;

either said opening is leading from the lower to the upper channel section into a vertically raised area of said gullet or a dirt filter is provided on top of the seepage area.

2. Drain channel system as in claim 1, wherein:

said drain channel consists of two U-shaped segments juxtapositioned with each other along their horizontal base surfaces.

3. Drain channel system as in claim 1, wherein:

said drain channel consists of an H-shaped element whose upper segment constitutes the upper channel section while its lower segment constitutes the lower channel section.

4. Drain channel system as in claim 1, wherein:

said gullet in the upper channel section has an asymrnetric cross-sectional profile offset in the direction of one channel side while the conduit openings are offset to the opposite side in a raised area of the gullet.

5. Drain channel system as in claim 1, wherein:

conduit openings between the upper channel section and the lower channel section are positioned in symmetric mirror-image fashion relative to the central longitudinal axis of the channel.

6. Drain channel system as in claim 1, wherein:

ends of the drain channel not connected to a box drain are closed off with end caps which prevent water from entering or exiting.

7. Drain channel system as in claim 1, wherein:

lower channel section is wider than the upper channel section.

8. Drain channel system as in claim 1, wherein:

width of the intake area in the upper channel section that is open toward the top at least matches the width of said gullet.

9. Drain channel system as in claim 1, wherein:

the upper channel section is laterally delimited by vertical walls which walls are provided at their top ends with angular brackets designed to hold screening grates.

10. Drain channel system as in claim 1, wherein:

the lower channel section is laterally supported by concrete fills.

11. Drain channel system as in claim 1, wherein:

the drain channel comprises two parts and is composed of separate profile elements for the upper channel section and the lower channel section and that said profile elements are identical.

12. Drain channel system, comprising:

a channel which is open toward the bottom, wherein a lower channel section includes a continuous cavity which is open toward the bottom and underneath which a seepage area is located for draining off surface water;

said cavity is connected to at least one of a cistern-type reservoir, a box drain or collecting tank;

said reservoir or box drain or collecting tank is connected on its part to a device for feeding in surface water;

a mouth of the cavity leading into at least one of the reservoir, box drain or collecting tank is located at a distance above the bottom of the at least one of the reservoir, box drain, or collecting tank;

the surface-water feed-in device is comprised of an upper channel section which is separated from the lower channel section by at least one horizontal partition; and the upper channel section incorporates an intake area that is open toward the top, as well as a gullet designed to collect and transport incoming water and connected to at least one the reservoir, box drain or collecting tank.

13. Drain channel system as in claim 12, wherein:

the upper channel section and the lower channel section are provided with conduit openings for the direct feed-in of water from the upper channel section into the lower channel section.

14. Drain channel system as in claim 12, wherein:

a baffle is provided in the area where the upper channel section leads into the box drain, which baffle extends from the base of the gullet to a specific height so that only the water overflow from the gullet enters the box drain.

15. Drain channel system as in claim 12, wherein:

the ends of the drain channel not connected to a box drain are closed off with end caps which prevent water from entering or exiting.

16. Drain channel system as in claim 12, wherein:

the lower channel section is wider than the upper channel section.

17. Drain channel system as in claim 12, wherein:

the lower channel section is laterally supported by concrete fills.

18. Drain channel system as in claim 12, wherein:

said drain channel consists of two parts and is comprised of separate profile elements for the upper channel section and the lower channel section, which profile elements are identical.

19. Drain channel system as in claim 12, wherein:

a dirt filter is provided between the surface-water feed-in device and the cavity and said dirt filter comprises a metallic mesh, a geofabric or a louvered separator.

* * * * *